United States Patent [19]

Bloom et al.

[11] Patent Number: 4,651,051

[45] Date of Patent: Mar. 17, 1987

[54] CATHODE-RAY TUBE HAVING A FOCUSING COLOR-SELECTION STRUCTURE AND A VIEWING SCREEN FORMED THEREFROM

[75] Inventors: Stanley Bloom, Bridgewater Township, Somerset County; Eric F. Hockings, Princeton Borough, both of N.J.

[73] Assignee: RCA Corporation, Princeton, N.J.

[21] Appl. No.: 751,863

[22] Filed: Jul. 5, 1985

[51] Int. Cl.[4] ..... H01J 29/50

[52] U.S. Cl. ..... 313/409; 313/403; 313/402; 313/408; 445/36; 445/47

[58] Field of Search ..... 313/409, 474, 403, 375, 313/368, 402; 445/36, 47

[56] References Cited

U.S. PATENT DOCUMENTS

| | | | |
|---|---|---|---|
| 2,625,734 | 1/1953 | Law | 29/25.13 |
| 3,437,482 | 4/1969 | Yamada et al. | 96/36.1 |
| 3,451,812 | 6/1969 | Tamura | 96/36.1 |
| 3,661,581 | 5/1972 | Feldstein | 96/36.1 |
| 3,663,997 | 5/1972 | Kuznetzoff | 29/25.14 |
| 3,725,065 | 4/1973 | Fadner, Jr. | 96/36.1 |
| 3,770,434 | 11/1973 | Law | 96/36.1 |
| 3,811,926 | 5/1974 | Smith | 117/101 |
| 4,049,451 | 9/1977 | Law | 96/36.1 |
| 4,112,562 | 9/1978 | D'Amato | 29/25.14 |
| 4,316,126 | 2/1982 | Hockings et al. | 315/375 |

FOREIGN PATENT DOCUMENTS

| | | | |
|---|---|---|---|
| 2814391 | 10/1978 | Fed. Rep. of Germany . | |
| 0147852 | 9/1982 | Japan | 313/402 |

OTHER PUBLICATIONS

RCA Technical Note No. 411, published Jan. 1961, by Harold B. Law, entitled, "Deflector-Mask Color Kinescope".

*Primary Examiner*—David K. Moore
*Assistant Examiner*—M. Razavi
*Attorney, Agent, or Firm*—Eugene M. Whitacre; Dennis H. Irlbeck; Vincent J. Coughlin, Jr.

[57] ABSTRACT

The novel CRT includes a color-selection structure which comprises a first electrode having a plurality of column and row elements forming a plurality of apertures, and a second electrode including an array of conductors electrically insulated from the first electrode. The plurality of apertures in the first electrode comprise alternate columns of first and second apertures. The first apertures have a width less than the width of the second apertures which are intersected by the conductors of the second electrodes to form first and second windows. The CRT also includes a viewing screen comprising an array of substantially parallel phosphor stripes of three different emission colors arranged in cyclic order in adjacent triads. Each of the triads of phosphor stripes is associated with a column of first and second windows and a column of first apertures. The column of first apertures is aligned with one of the phosphor stripes of the triad and is flanked on one side by a column of first windows and on the other side by a column of second windows. A method of producing an image screen using the novel color-selection structure is also disclosed. The method comprises the steps of: (a) providing the conductors of the second electrode of the color-selection structure with an opaque light blocking structure to temporarily close the first and second windows, (b) projecting light through the first apertures of the first electrode whereby to photodeposit the screen, and (c) then removing the opaque light blocking structure from the conductors of the second electrode to open the first and second windows.

5 Claims, 5 Drawing Figures

CATHODE-RAY TUBE HAVING A FOCUSING COLOR-SELECTION STRUCTURE AND A VIEWING SCREEN FORMED THEREFROM

BACKGROUND OF THE INVENTION

The invention relates to an improved focus mask type cathode-ray tube (CRT) and, more particularly, to an improved color-selection structure for such a tube having a first electrode comprising conductors forming a plurality of alternate columns of first and second apertures and a second electrode including an array of conductors which intersect the second apertures to form first and second windows. The invention further includes a method of producing a luminescent viewing screen using the improved color-selection structure.

A commercial shadow-mask-type CRT comprises generally an evacuated envelope having therein a target or viewing screen comprising an array of phosphor elements of three different emission colors arranged in a cyclic order, means for producing three convergent electron beams directed towards the target, and a color-selection structure including an apertured masking plate between the target and the beam-producing means. The masking plate shadows the target, and the differences in convergence angles permit the transmitted portions of each beam, or beamlets, to select and excite phosphor elements of the desired emission color.

At about the center of the color-selection structure, the masking plate of a commercial CRT intercepts all but about 18% of the beam currents; that is, the plate is said to have a transmission of about 18%. Thus, the area of the apertures of the plate is about 18% of the area of the plate. Since there are no focusing fields present, a corresponding portion of the target is excited by the beamlets of each electron beam.

Several methods have been suggested for increasing the transmission of the masking plate; that is, increasing the area of the apertures with respect to the area of the plate, without substantially increasing the excited portions of the target area. In one approach, the apertures are enlarged, and the beamlets are focused by magnetic or electric fields produced in the vicinity of each of the apertures. In a second approach, each aperture in the masking plate is enlarged and split into two adjacent windows by a conductor. The two beamlets passing through the windows of each aperture are deflected around the conductor towards one another, and both beamlets fall on substantially the same area of the target. In this second approach, the transmitted portions of the beams are also focused in one transverse direction and defocused in the orthogonal transverse direction.

One effort at such a combined deflection-and-focus color-selection means is described in West German Offenlegungschrift No. 2,814,391, published Oct. 19, 1978. The color-selection structure described therein comprises a metal masking plate having an array of substantially square apertures arranged in vertical columns and an array of narrow vertical conductors insulatingly spaced from the masking plate, with each conductor substantially centered over the apertures of one of the columns of apertures. Each aperture is also centered over a triad of phosphor stripes. Viewed from the electron-beam-producing means, the conductors divide each aperture into two essentially-equal horizontally-coadjacent windows. This prior color-selection structure has windows with a width-to-height ratio of about 0.46 and transmits about 44% or less of the electron beams.

When operating this latter device, the narrow vertical conductors are electrically positive with respect to the masking plate, so that the beamlets passing through each of the windows of the same aperture are deflected towards one another. Simultaneously, because of quadrupole-like focusing fields established in the windows, the beamlets are focused in the length direction of the phosphor stripes (compressed vertically) and defocused in the width direction of the phosphor stripes (stretched horizontally). The spacings and voltages are so chosen to form an electrostatic lens that also deflects the two beamlets to fall on the same phosphor stripe of the target.

The shapes of the deflected beamlets passing through each window, because they are elongated in the width (horizontal) direction and compressed in the length (vertical) direction, cause an overlapping of the beamlets onto the adjacent incorrect color phosphor stripe, or require a reduction in the widths of the windows, to assure adequate color purity in the image displayed on the target.

U.S. Pat. No. 4,316,126 issued to Hockings et al. on Feb. 16, 1982, overcomes the drawbacks of the former deflection-and-focus color-selection structure by disclosing a color-selection structure for a CRT which focuses the beamlets in the narrow width direction of the phosphor stripes and defocuses the beamlets in the long length direction of the phosphor stripes. In the latter color-selection structure, a metal masking plate has a array of apertures arranged in columns that are substantially parallel to the length of the phosphor stripes. An array of narrow conductors extend substantially parallel to the length of the stripes. The conductors are insulatingly spaced from the masking plate and are located opposite and spaced from the boundaries between adjacent triads. Each conductor is substantially centered over the apertures of one of the columns, so that the masking plate and the conductors define an array of windows for transmitting therethrough portions of the electron beams.

During the operation of the CRT using the latter color-selection structure, the polarities on the masking plate and the conductors are maintained so that the conductors are negative with respect to the masking plate. When so operated, the beamlets passing through each of the windows of the same apertures are directed away from one another. Beamlets from adjacent windows fall on the same stripe of the target. This requires the boundary of each triad, rather than the center of each triad, to be opposite the conductor. By using this arrangement of color-selection structure and screen and by operating the CRT in this manner, the transmitted beamlets are compressed (focused) in the direction normal to the lengths of the conductors and the phosphor stripes and are stretched (defocused) in the direction parallel to the lengths of the conductors and of the phosphor stripes. This reduces the widths of the beamlets and permits the transmission of the color-selection structure to be increased with improved registration of the beamlets on the phosphor stripes. The windows of the latter described color-selection structure have width-to-height ratios in the range of 0.8 to 1.1. With such ratios, transmission greater than 44% has been achieved without sacrificing color purity.

Neither of the aforedescribed color-selection structures provides means for producing a viewing screen or target having vertical phosphor stripes, using the color-selection structure as a master as is known in the art relating to shadow mask type CRT's and described in U.S. Pat. No. 4,049,451, issued to Law on Sept. 20, 1977.

SUMMARY OF THE INVENTION

The novel CRT is similar in structure to the prior CRT's mentioned above except for the color-selection structure, which comprises a first electrode having a plurality of column and row elements forming a plurality of apertures, and a second electrode including an array of conductors electrically insulated from the first electrode. The plurality of apertures in the first electrode comprise alternate columns of first and second apertures. The first apertures have a width less than the width of the second apertures which are intersected by the conductors of the second electrodes to form first and second windows. The CRT also includes an viewing screen comprising an array of substantially parallel phosphor stripes of three different emission colors arranged in cyclic order in adjacent triads. Each of the triads of phosphor stripes is associated with a column of first and second windows and a column of first apertures. The column of first apertures is aligned with one of the phosphor stripes of the triad and is flanked on one side by a column of first windows and on the other side by a column of second windows.

A method of producing the viewing screen using the novel color-selection structure is also disclosed. The method comprises the steps of: (a) providing the conductors of the second electrode of the color-selection structure with light-blocking means to temporarily close the first and second windows, (b) projecting light through the first apertures of the first electrode whereby to photodeposit the screen, and (c) then removing the light-blocking means from said conductors of the second electrode to open the first and second windows.

DETAILED DESCRIPTION OF THE PREFERRED EMBODIMENT

Figure 1:
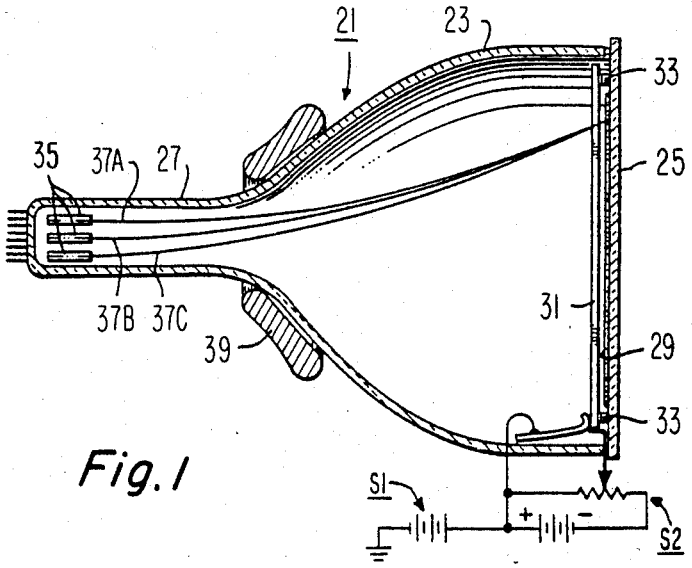
FIG. 1 is a partially-schematic top view of an embodiment of a novel cathode-ray tube (CRT).

The novel cathode-ray tube 21, shown in FIG. 1, comprises an evacuated envelope 23 including a transparent faceplate 25 at one end and a restricted neck 27 at the other end. The faceplate 25, which is shown as flat but may arch outwardly, supports a luminescent viewing screen 29 on its inner surface. Also, a color-selection structure 31 is detachably attached from three supports 33 on the inside surface of the faceplate 25. An inline electron gun 35 comprising means for generating three convergent inline electron beams 37A, 37B and 37C is disposed in the neck 27. The beams are generated in a plane, which is preferably horizontal when the CRT is in the usual viewing position. The beams are directed towards the screen 29 with the outer beams 37A and 37C convergent on the center beam 37B at the screen 29. The three beams are deflected with the aid of a deflection coil 39 to scan a raster over the color-selection structure 31 and the viewing screen 29.

Figure 3:
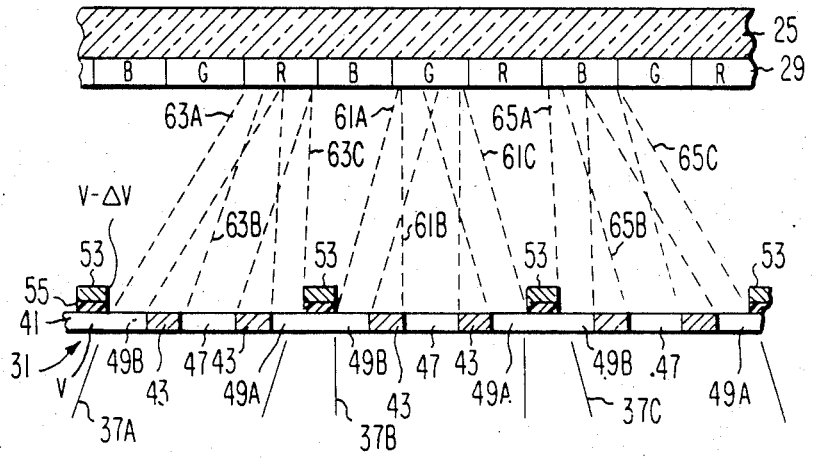
FIG. 3 is a partially-schematic, sectional top view of fragments of the color-selection structure and viewing screen of FIG. 1 showing typical focused convergent electron paths during the operation of the novel CRT.
Figure 2:
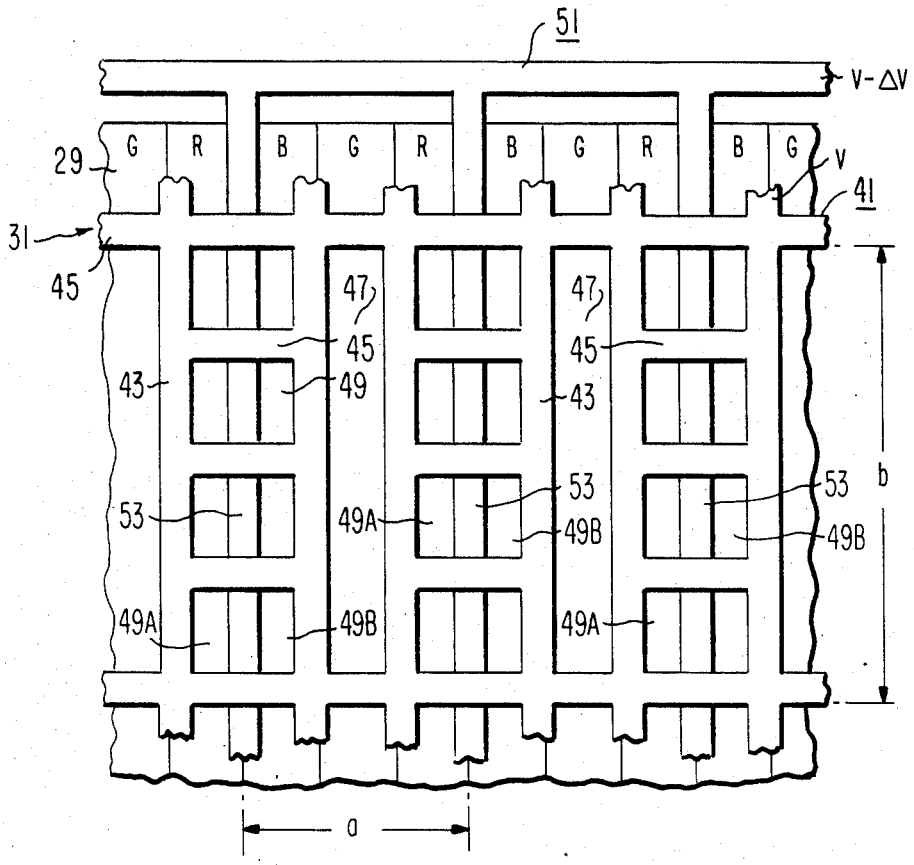
FIG. 2 is a plan view of fragments of the color-selection structure and the viewing screen of the CRT shown in FIG. 1.

The viewing screen 29 and the color-selection structure 31 are described in more detail with respect to FIGS. 2 and 3. The viewing screen 29 is comprised of a large number of red-emitting, green-emitting and blue-emitting phosphor stripes R, G and B, respectively, arranged in adjacent triads in a cyclic order with each triad containing a stripe of each of the three different emission colors. The stripes extend in a direction which is generally normal to the plane in which the electron beams are generated. In the usual viewing position for this embodiment, the phosphor stripes extend in the vertical direction.

As shown in FIGS. 2 and 3, the color-selection structure 31 comprises a masking plate or first electrode 41 lying in a first plane and having a plurality of column elements 43 and row elements 45 which form a plurality of electron-transmitting apertures. The apertures in the first electrode 41 comprise alternate columns of substantially rectangular first apertures 47 and second apertures 49. The apertures 47 and 49 are arranged in columns which are parallel to the long direction of the phosphor stripes R, G and B, there being two columns of apertures for each triad of stripes. The color-selection structure 31 also includes a second electrode 51 lying in a second plane and comprising an array of conductors 53 substantially parallel to the phosphor stripes. The conductors 53 are electrically insulated and closely spaced from the first electrode 41 by means of a plurality of insulating members 55, shown in FIG. 3, that are about 0.025 mm (1 mil) thick. A conductor 53 extends down each column of second apertures 49 on the screen side of the first electrode 41 and opposite each triad boundary; that is, opposite the boundary between the red and blue stripes R and B. Alternatively, the conductors 53 may extend down each column of second apertures on the beam-producing side of the first electrode 41. The conductors 53 are so positioned over each of the second apertures 49 so as to intersect the second apertures and leave two substantially equal electron-transmitting windows comprising a first window 49A and a second window 49B. Each of the triads of phosphor stripes is associated with a column of first apertures 47 and first and second windows 49A and 49B, respectively, so that there are three electron-transmitting openings per triad. The first apertures 47 are centered with respect to one of the phosphor stripes, e.g. the green stripe, and flanked on one side by a column of first windows 49A, and on the other side by a column of second windows 49B.

In the embodiment shown in FIGS. 2 and 3, the first apertures 47 have a width in the plane of the electron beams of about 0.2 mm (8 mils) and a height of about 1.42 mm (56 mils). The width of each of the column and row elements 43 and 45 of the first electrode is about 0.11 mm (4 mils). The second apertures 49 have a width of about 0.36 mm (14 mils) and a height of about 0.28 mm (11 mils). The conductors 53 are about 0.11 mm (4 mils) wide leaving two equal windows 49A and 49B on each side thereof that are about 0.13 mm (5 mils) wide and 0.28 mm (11 mils) high. The first electrode 41 is spaced about 13.72 mm (540 mils) from the phosphor stripes R, G and B, each of which has a width of about 0.28 mm (11 mils). The transmission of the color-selection structure 31 described herein is about 49 percent which is greater than the previously described deflection-and-focus color-selection structures having only two electron-transmitting openings per triad. The relatively narrow first apertures 47 having a width less than the width of the phosphor stripes permits the color-selection structure 31 to be used to form the viewing screen 29, as described hereinafter.

All of the sizes given herein are exemplary and may be varied. The first and second windows 49A and 49B are uniformly sized but may be, if desired, graded in size from the center to the edge of the color-selection structure 31 by outwardly displacing the conductors 53 of the second electrode 51 to compensate for vignetting caused by the second electrode 51 lying in a different plane than the first electrode 41. Also, the spacing between the color-selection structure 31 and the stripes R, G and B is uniform but may be graded from the center to the edge of the color-selection structure. To improve the light output of the screen 29, the surfaces of the stripes R, G and B toward the electron gun 35 may be coated with a thin layer of a light reflective material, such as aluminum. While a metal masking plate 41 is, and conductors 53 are, preferred for the first and second electrodes of the color-selection structure 31, the color-selection structure may be formed of woven mesh members, such as are described in U.S. Pat. No. 4,470,822, issued to Bloom et al. on Sept. 11, 1984, and assigned to the assignee of the present invention. If a woven structure is used, the column and row elements of the woven structure corresponding to column and row elements 43 and 45 of the first electrode 41 are electrically connected together and operated at a first voltage, while the column elements corresponding to conductors 53 of the second electrode are electrically isolated from the first electrode 41 and operated at a second voltage.

To operate the tube 21, the electron gun 35 is energized with suitable operating voltages. A first potential (V) of about 25,000 volts is applied to the screen 29, and to the first electrode 41 of the color-selection electrode 31 from a voltage source S1, shown schematically in FIG. 1. A second potential ($V-\Delta V$) from a voltage source S2 is applied to the second electrode 51 and conductors 53. The second potential is within the range of about 24,470 volts to about 24,750 volts and will provide color purity, i.e., focus the electron beams within a single phosphor stripe. Three convergent beams 37A, 37B and 37C from electron gun 35 are made to scan a raster on the viewing screen 29 with the aid of the deflection coils 39. As shown in FIG. 3, the beams approach the color-selection electrode 31 at different but definite angles. FIG. 3 shows only those portions of the beams 37A, 37B and 37C that are of interest for this analysis. Actually, the beams are wider, spanning many apertures and producing many beamlets.

The electrostatic fields produced by the differences in voltages on the first electrode 41 and the conductors 53 of the second electrode 451 cause those beamlets that pass through the first and second windows 49A and 49B to be deflected away from the conductors 53. Also, there is some focusing of the beamlets normal to the direction of the conductors 53, so that the beamlets are compressed in that direction. Beamlets passing through the first apertures 47 are neither electrostatically deflected nor compressed, because the column and row elements 43 and 45 of the first electrode 41, which completely surround the first apertures, operate at the first potential (V). Accordingly, the first apertures 47 operate in the same manner as the apertures in a conventional shadow mask. Because of the spacing between the color-selection structure 31 and the stripes R, G and B in combination with the different convergence angles, beamlets from the first and second windows 49A and 49B flanking the first apertures 47 fall on the same phosphor stripe in overlapping fashion. For example, as shown in FIG. 3, the center beam 37B typically produces three adjacent beamlets 61A, 61B and 61C passing through the second window 49B, the first aperture 47 and the first window 49A, respectively, which fall on the green-emitting stripe G. Similarly, but at a different angle, one side beam 37A produces three adjacent beamlets 63A, 63B and 63C from second window 49B, first aperture 47 and first window 47A, respectively, which fall on the same red-emitting stripe R; and the other side beam 37C produces three adjacent beamlets 65A, 65B and 65C from second window 49B, first aperture 47 and first window 49A, respectively, which fall on the same blue-emitting stripe B.

Figure 4:
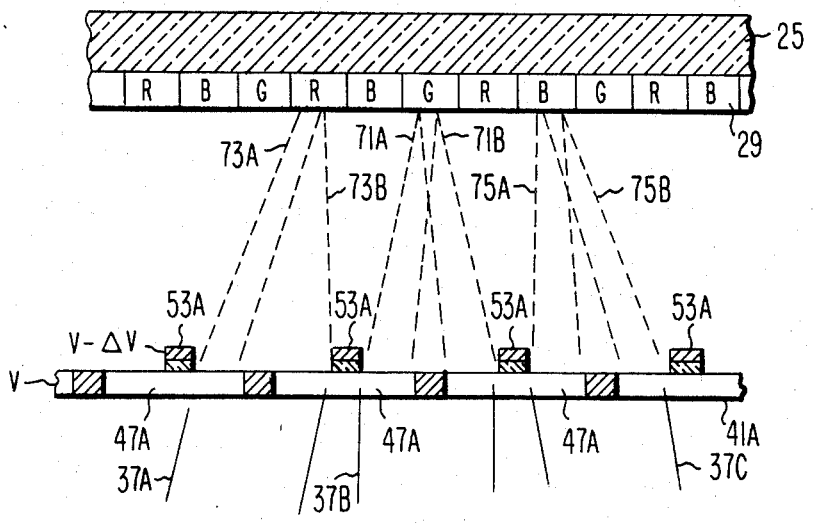
PRIOR ART Fig. 4
FIGS. 4 and 5 are diagrams similar to that of FIG. 3 but for prior CRT's and modes of operation showing typical convergent electron paths during operation of the CRT's.

Referring now to FIG. 4, the foregoing operation is to be compared with the CRT and mode of operation disclosed in the above-cited U.S. Pat. No. 4,316,126. As in the present structure, the conductors 53A of the second electrode are opposite each triad boundary; that is, opposite the boundary between the red and blue stripes R and B on the screen 29. In this embodiment, the masking plate or first electrode 41A comprises a column of apertures 47A. The conductors 53A extend down each column of apertures 47A, so as to leave two substantially equal electron-transmitting openings. In this embodiment, the apertures 47A at the center of the first electrode 41A are about 0.65 mm (26 mils) wide by 0.31 mm (12 mils) high. The apertures are spaced about 0.15 mm (6 mils) apart from adjacent apertures above and below. To the sides, the spacing is about 0.11 mm (4 mils). The conductors are about 0.15 mm (6 mils) wide, leaving two equal openings on each side thereof that are about 0.31 mm (12 mils) high and 0.25 mm (10 mils) wide. The first electrode 41A is spaced about 13.72 mm (540 mils) from the phosphor stripes R, G and B, each of which has a width of about 0.28 mm (11 mils). The tube is operated in a manner similar to the tube 21 described herein. The electrostatic field produced by the differences in voltages on the first electrode 41A and the conductors 53A of the second electrode 51A cause the beamlets that pass through the openings of the apertures 47A to be deflected away from the conductors 53A. Also, as in the present case, there is some focusing of the beamlets normal to the direction of the conductors 53A, so that the beamlets are compressed in that direction. Because of the spacing btween the first electrode 41A and the stripes R, G and B in combination with the different convergence angles, adjacent beamlets from adjacent apertures 47A fall on the same phosphor stripe in overlapping fashion. For example, as shown in FIG. 4, the center beam 37B typically produces two adjacent beamlets 71A and 71B passing through adjacent openings of adjacent apertures 47A which fall on a green-emitting stripe G. The same deflection and focusing occurs at each pair of adjacent openings of adjacent apertures 47A as the center beam 37B scans across the viewing screen 29. Similarly, but at a different angle, one side beam 37A produces two adjacent beamlets 73A and 73B from adjacent openings of adjacent apertures which fall on the same red-emitting stripe R, and the other side beam 37C produces two adjacent beamlets 75A and 75B from adjacent openings of adjacent apertures which fall on the same blue-emitting stripe B.

Figure 5:
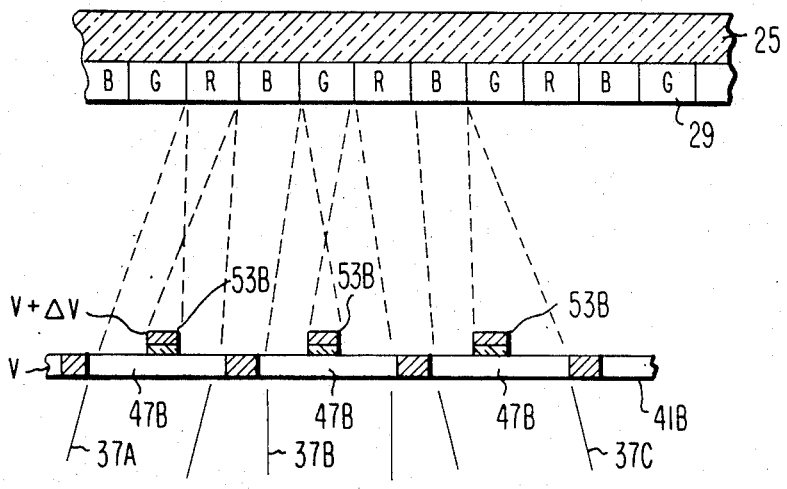
PRIOR ART Fig. 5

Referring now to FIG. 5, the CRT and the mode of operation disclosed in the above-cited West German publication will be compared to the present novel structure. Some of the physical dimensions of the structures shown in FIGS. 3, 4 and 5 are tabulated in the TABLE. In the prior structure (FIG. 5), the conductors 53B are centered on the triads. The conductors 53B carry a positive voltage of about 25,000 volts plus about 900 volts ($V+\Delta V$), and the first electrode 41B carries a positive voltage of about 25,000 volts. As shown in FIG. 5, the beamlets passing through the openings of apertures 47B are deflected towards one another with defocusing action in the direction normal to the length of the conductors 53B, so that the two beamlets fall on the same phosphor stripe. Because the beamlets are defocused or expanded in this direction, they must be strictly limited in size to avoid overlapping and exciting adjacent phosphor stripes.

TABLE

Some Physical Dimensions In Millimeters Of Structures Of Figures 3, 4 and 5

| | Figure 3 (Novel CRT) | Figure 4 (Prior CRT) | Figure 5 (Prior CRT) |
|---|---|---|---|
| Horizontal repeat distance "a" | 0.76 | 0.76 | 0.80 |
| Vertical repeat distance "b" | 1.52 | 0.45 | 0.80 |
| First-aperture width | 0.2 | 0.65 | 0.56 |
| First-aperture height | 1.42 | 0.31 | 0.56 |
| Second-aperture width | 0.36 | — | — |
| Second-aperture height | 0.28 | — | — |
| Horizontal aperture separation | 0.11 | 0.11 | 0.24 |
| Vertical aperture separation | 0.11 | 0.14 | 0.24 |
| Conductor width | 0.11 | 0.15 | 0.04 |
| Window width | 0.13 | 0.25 | 0.26 |
| Window height | 0.28 | 0.31 | 0.56 |
| Number of structure openings per triad | 3 | 2 | 2 |

The present color-selection structure 31 provides all the performance advantages of the structure disclosed in U.S. Pat. No. 4,316,126, cited above, with the additional advantage that the color-selection structure 31, having three electron-transmitting openings per triad, can be used to form the imaging screen 29. The first apertures 47 of the present structure 31 have a sufficiently narrow width (0.2 mm) to permit the structure 31 to be used with a conventional lighthouse and line light source, such as that disclosed in U.S. Pat. No. 4,049,451, issued to Law on Sept. 20, 1977, and assigned to the assignee of the present invention. The aforementioned patent is incorporated by reference herein for the purpose of disclosure.

In order to form the screen 29, the first and second windows 49A and 49B, each having a width of 0.13 mm, are temporarily blocked by, e.g., depositing opaque charged particles electrophoretically from suspension onto their common 0.11 mm wide conductors 53 which are electrically isolated from the first electrode 41. Electrophoretic desposition is well known in the art and need not be described. Since the column and row elements 43 and 45 surrounding the first apertures 47 of the first electrode 41 are at a common potential, the charged particles will not block the first apertures 47. The color-selection structure 31 may then be detachably attached to the supports 33 on the faceplate 25. Light is projected through the first apertures 47, and the screen 29 is photodeposited by methods well known in the art, such as that found in U.S. Pat. No. 2,625,734, issued to Law on Jan. 20, 1953, and incorporated herein for the purpose of disclosure. After the phosphor stripes R, G and B are provided, the color-selection structure 31 is removed from the faceplate, and the opaque particles are stripped from the conductor 53 by the application of a suitable opposite polarity voltage. Alternatively, the conductors 53 could be provided by thin wings that would block the apertures 49A and 49B and which could be removed by etching after the screen 29 is formed.

What is claimed is:

1. In a cathode-ray tube including (a) a viewing screen comprising an array of substantially parallel phosphor stripes of three different emission colors arranged in cyclic order in adjacent triads, each triad comprising a stripe of each of said three different emission colors, (b) means for generating three convergent inline electron beams directed toward said viewing screen in a plane that is substantially normal to said stripes, and (c) a color selection structure positioned between said viewing screen and said beam producing means, said structure comprising (i) a first electrode having a plurality of column elements and row elements, said column elements and row elements forming a plurality of apertures, and (ii) a second electrode including an array of conductors substantially parallel to said phosphor stripes, said conductors being electrically insulated from said first electrode, the improvement wherein said plurality of apertures in said first electrode of said color-selection structure comprise alternate columns of first and second apertures, said first apertures having a width in the plane of the electron beams less than the width of said second apertures, said second apertures being intersected by said array of conductors of said second electrode to form first and second windows, each of said triads of phosphor stripes being associated with a column of first and second windows and a colum of first apertures, said column of first apertures being aligned with one of said phosphor stripes of said triad and flanked on one side by a column of first windows and on the other side by a column of second windows.

2. In a cathode-ray tube including (a) a viewing screen comprising an array of substantially parallel phosphor stripes of three different emission colors arranged in cyclic order in adjacent triads, each triad comprising a stripe of each of said three different emission colors, (b) an inline electron gun for generating three convergent inline electron beams directed toward said viewing screen in a plane that is substantially normal to said stripes, and (c) a color-selection structure positioned between said viewing screen and said electron gun, said color-selection structure comprising (i) a first electrode having a plurality of column elements and row elements, said column elements and row elements forming a plurality of apertures, and (ii) a second electrode including an array of conductors substantially parallel to said phosphor stripes, said conductors being electrically insulated from said first electrode, the improvement wherein said plurality of apertures in said first electrode of said color-selection structure comprise alternate columns of first and second apertures, each of said first apertures having a width in the plane of said electron beams less than the width of one of said phosphor stripes and a width less than the width of said second apertures, each of said second apertures being intersected by one of said conductors of said second electrode to form first and second windows, each of said first and second windows having a width less than the width of said first apertures, each of said triads of phosphor stripes being associated with a column of first and second windows and a column of first apertures, said column of first apertures being centered with respect to one of the phosphor stripes of said triad, said column of first apertures being flanked on one side by a column of first windows and on the other side by a column of second windows.

3. The tube as described in claim 2 further including means for applying a first voltage to said first electrode and a second voltage to said second electrode, said first voltage being different from said second voltage.

4. The tube as described in claim 3 wherein said first voltage is greater than said second voltage.

5. In a process of manufacture, a cathode-ray tube including a viewing screen and a color-selection structure having a first electrode comprising a plurality of column elements and row elements forming a plurality of alternate columns of first and second apertures, said second apertures being intersected by an array of conductors of a second electrode to form first and second windows, said second electrode being electrically insulated from said first electrode, the improvement comprising the steps of:

(a) providing said conductors of said second electrode with light-blocking means thereby temporarily closing said first and second windows, (b) projecting light through said first apertures whereby to photodeposit said screen, and (c) then removing said light-blocking means from said conductors of said second electrode to open said first and second windows.

* * * * *